US008001638B1

(12) United States Patent
Quinter et al.

(10) Patent No.: US 8,001,638 B1
(45) Date of Patent: Aug. 23, 2011

(54) SIZE CONVERTIBLE MATTRESS

(75) Inventors: Geoffrey R. Quinter, Earlville, PA (US); Eric Holzer, Coopersburg, PA (US); Nicole Meluskey, Center Valley, PA (US); Lauren C. Gatto, Bethlehem, PA (US)

(73) Assignee: FXI, Inc., Media, PA (US)

( * ) Notice: Subject to any disclaimer, the term of this patent is extended or adjusted under 35 U.S.C. 154(b) by 0 days.

(21) Appl. No.: 12/715,018

(22) Filed: Mar. 1, 2010

(51) Int. Cl.
*A47C 17/00* (2006.01)

(52) U.S. Cl. ..... 5/722; 5/723; 5/739; 5/690; 5/694

(58) Field of Classification Search ..... 5/690, 694, 5/400, 739, 722, 723, 661, 401
See application file for complete search history.

(56) References Cited

U.S. PATENT DOCUMENTS

| | | | | | |
|---|---|---|---|---|---|
| 3,902,759 | A | * | 9/1975 | Monteforte et al. | 5/12.1 |
| 4,361,919 | A | | 12/1982 | Hull | |
| 4,525,883 | A | | 7/1985 | Necowitz | |
| 4,639,952 | A | * | 2/1987 | Kensinger | 5/13 |
| D317,994 | S | | 7/1991 | Collins | |
| 5,115,524 | A | * | 5/1992 | Antosko | 5/99.1 |
| 5,513,402 | A | | 5/1996 | Schwartz | |
| 5,566,409 | A | | 10/1996 | Klearman | |
| 5,701,623 | A | | 12/1997 | May | |
| 5,715,551 | A | | 2/1998 | Proano et al. | |
| 5,754,993 | A | | 5/1998 | Russell | |
| 5,819,349 | A | | 10/1998 | Schwartz | |
| 5,822,817 | A | | 10/1998 | Carew et al. | |
| 5,867,849 | A | * | 2/1999 | Pontrello | 5/2.1 |
| 5,937,465 | A | | 8/1999 | Carew et al. | |
| 6,026,525 | A | | 2/2000 | Davis | |
| 6,141,808 | A | * | 11/2000 | Akado | 5/690 |
| 6,192,538 | B1 | | 2/2001 | Fogel | |
| 6,357,065 | B1 | * | 3/2002 | Adams | 5/618 |
| 6,408,463 | B1 | | 6/2002 | Palacio | |
| D467,117 | S | | 12/2002 | Guy | |
| 6,550,082 | B2 | | 4/2003 | Tharalson et al. | |
| 6,711,766 | B2 | * | 3/2004 | Monk et al. | 5/740 |
| 6,957,464 | B1 | | 10/2005 | Coauette | |
| 6,971,132 | B2 | | 12/2005 | Feinsod | |
| 7,165,282 | B2 | | 1/2007 | Watson | |
| 7,225,489 | B1 | * | 6/2007 | Frickey et al. | 5/690 |
| 7,246,388 | B2 | | 7/2007 | DiLiberto, Jr. | |
| 7,363,668 | B2 | | 4/2008 | Chen | |
| 7,404,219 | B2 | | 7/2008 | Berkey | |
| D581,714 | S | | 12/2008 | Godoy | |
| 7,520,468 | B2 | * | 4/2009 | Doebertin et al. | 244/118.5 |
| RE40,754 | E | | 6/2009 | Morton | |
| 7,552,493 | B2 | * | 6/2009 | McNulty | 5/723 |
| 7,895,692 | B1 | * | 3/2011 | Najafi pour | 5/694 |
| 2003/0000021 | A1 | | 1/2003 | O'Connell et al. | |
| 2004/0055086 | A1 | | 3/2004 | Owens et al. | |
| 2006/0016013 | A1 | | 1/2006 | Lord et al. | |

(Continued)

*Primary Examiner* — Robert G Santos
*Assistant Examiner* — Brittany Wilson
(74) *Attorney, Agent, or Firm* — Connolly Bove Lodge & Hutz LLP

(57) ABSTRACT

A mattress converts from a crib mattress with side walls and end walls surrounding an infant sleeping surface on a central mattress section therebetween to a twin mattress with a substantially planar sleeping surface to support a reclining child or adult. The end walls and side walls are tethered or hingedly connected to the central mattress section and are moveable from an upright position (crib mattress) to an open position (twin mattress). Sidewall extensions are hingedly connected to the side walls and are pivotably moveable from a first position above the side walls to a second position axially aligned with the side walls when the side walls are in the open position.

42 Claims, 4 Drawing Sheets

U.S. PATENT DOCUMENTS

2006/0031995 A1 2/2006 Barkhouse
2006/0123543 A1 6/2006 DiLiberto
2009/0158528 A1 6/2009 Frey

* cited by examiner

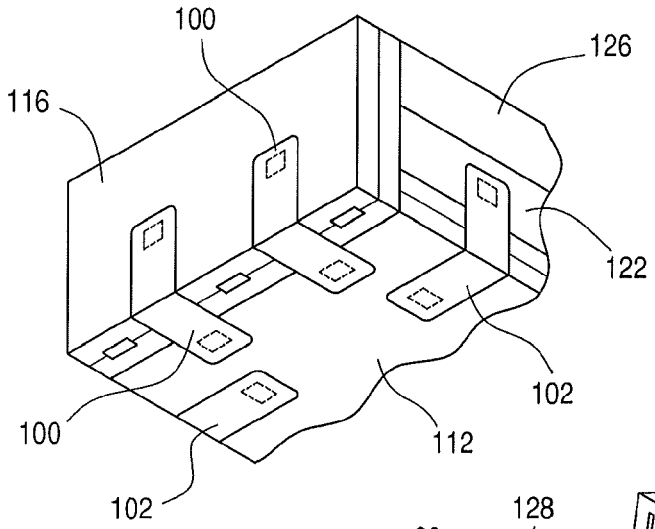
FIG. 7
FIG. 8
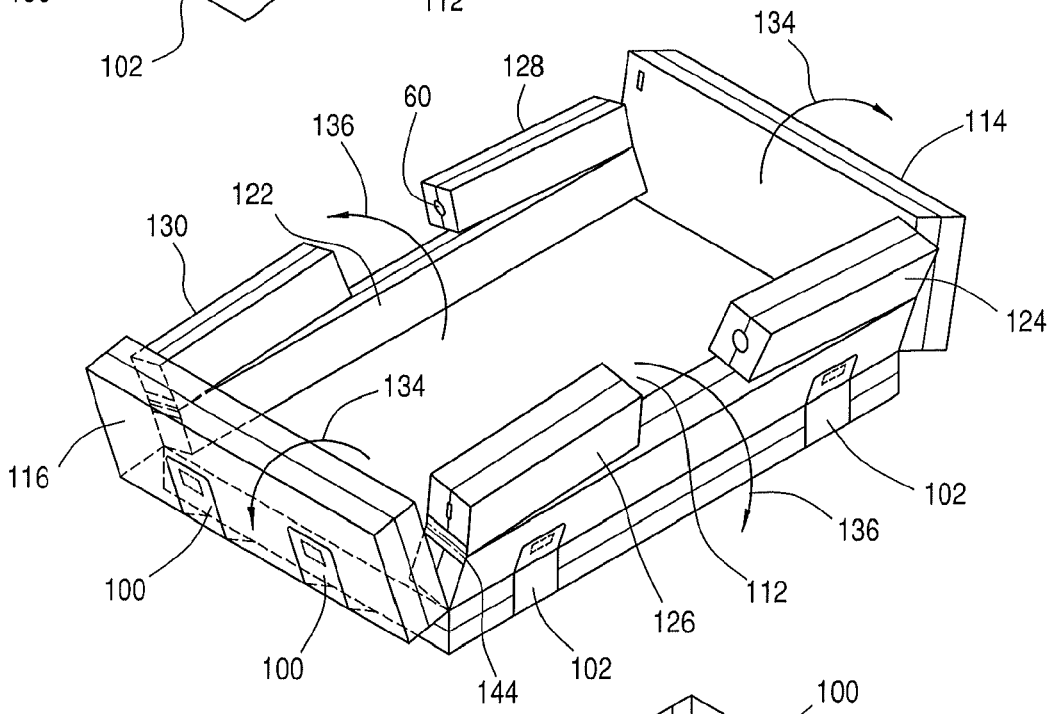
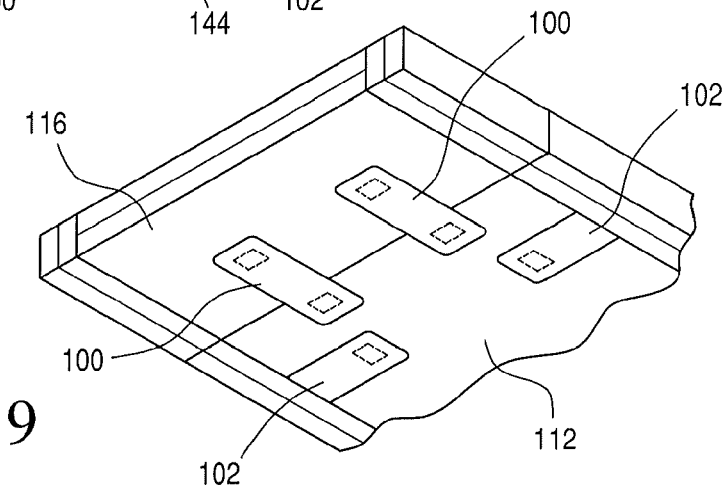
FIG. 9

SIZE CONVERTIBLE MATTRESS

FIELD OF THE INVENTION

This invention relates to bedding mattresses convertible from a first size suitable for use in an infant's crib to a second size suitable for use with a twin bed. The bedding mattress has sections that are hingedly connected so that they may be pivotably moved from a first position forming a mattress combined with sidewalls or bumpers for use in an infant's crib to a second position forming a twin-size mattress.

BACKGROUND

Infants generally sleep in cribs, with structure surrounding the sleeping surface to prevent the infant from rolling or falling off the sleeping surface. Frequently, the structure surrounding the sleeping surface comprises bars or poles or solid sidewalls. Various forms of cushioning material, usually called crib bumpers, may be installed to surround the sleeping surface and cover at least a portion of the bars or poles to protect the infant from bumping his or her head, and from poking arms or legs outside of the crib. See, e.g., U.S. Pat. No. 6,957,464.

Toddlers and younger children usually begin to sleep on regular bedding mattresses, frequently twin-sized mattresses. The twin-sized mattresses do not fit within the crib structure. Some infant cribs are designed to be converted from a crib to a child's twin-sized bed. See, e.g., U.S. Pat. Nos. 5,754,993; 5,715,551; 4,525,883 and 4,361,919.

While the infant crib may be convertible to a twin-sized bed frame, parents still must purchase a twin-sized mattress to be used with the converted bed frame. Parents prefer multi-use childrens' products, but the convertible cribs offered today do not come with convertible mattresses.

One convertible infant mattress is shown in U.S. Pat. Nos. 5,937,465 and 5,822,817. The mattress system defines a sleeping recess between upstanding walls in a configuration for use in a crib. The mattress system includes a separable accessory panel that is removed when the mattress system is installed in a crib. The accessory panel can be inserted into the recess, and the mattress system can then be inverted to provide a larger sleeping surface for a child as opposed to an infant. However, this mattress system with the accessory panel inserted still has the periphery dimensions of a crib mattress, and does not convert in size to that of a twin-size mattress.

A mattress that can be used in a crib for infants and converted to a twin-sized mattress for use on a standard bedding frame for toddlers and children continues to be sought. Moreover, crib mattresses that have upstanding sidewalls to serve as crib bumpers are desired by parents.

SUMMARY OF THE INVENTION

In one embodiment, a crib mattress that is convertible to a twin-sized bedding mattress has a central mattress section defining a top surface and first and second ends and left and right sides. A first end wall is hingedly connected to the central mattress section at the first end, and the first end wall is pivotably moveable from an upright position to an open position. A second end wall is hingedly connected to the central mattress section at the second end, and the second end wall is pivotably moveable from an upright position to an open position. A first side wall is hingedly connected to the central mattress section at the left side, and the first side wall is pivotably moveable from an upright position to an open position. A second side wall is hingedly connected to the central mattress section at the right side, and the second side wall is pivotably moveable from an upright position to an open position. Each side wall may have one or more sidewall extensions hingedly connected to an end of the side wall and pivotably moveable from a first position to a second position. In the first position, the lengthwise axis of a respective sidewall extension is parallel or substantially parallel to the lengthwise axis of the respective side wall to which it is connected. In the second position, the lengthwise axis of a respective sidewall extension is generally aligned with the lengthwise axis of the respective side wall to which it is connected. When the first and second end walls are in the open position, the first and second side walls are in the open position, and sidewall extensions are in the second position, a substantially planar body-supporting surface is formed that includes the central mattress section, the first and second end walls, the first and second side walls, and, preferably, the sidewall extensions.

In a second embodiment, a crib mattress that is convertible to a twin-sized bedding mattress has a central mattress section defining a top surface and first and second ends and left and right sides. A first end wall is tethered to the central mattress section at the first end, and the first end wall is separable from the central mattress section and moveable from an upright position to an open position. A second end wall is tethered to the central mattress section at the second end, and the second end wall is separable from the central mattress section and moveable from an upright position to an open position. A first side wall is tethered to the central mattress section at the left side, and the first side wall is moveable from an upright position to an open position. A second side wall is tethered to the central mattress section at the right side, and the second side wall is moveable from an upright position to an open position. Each side wall may have one or more sidewall extensions hingedly connected to an end of the side wall and pivotably moveable from a first position to a second position. In the first position, the lengthwise axis of a respective sidewall extension is parallel or substantially parallel to the lengthwise axis of the respective side wall to which it is connected. In the second position, the lengthwise axis of a respective sidewall extension is generally aligned with the lengthwise axis of the respective side wall to which it is connected. When the first and second end walls are in the open position, the first and second side walls are in the open position, and sidewall extensions are in the second position, a substantially planar body-supporting surface is formed that includes the central mattress section, the first and second end walls, the first and second side walls, and, preferably, the sidewall extensions.

The sidewall extensions may define one or more voids therein to receive an accessory or toy when the mattress is in the crib configuration.

The central mattress section, first end wall, second end wall, first side wall, second side wall, and the sidewall extensions preferably are formed of foam, such as polyurethane foam, viscoelastic foam, and/or latex foam. The mattress components may be formed of multiple layers of foams of varying resiliency or support characteristic. For example, the body-contacting surfaces in the twin bed configuration may be of a more resilient or softer foam. Such more resilient or softer foam may be co-molded or bonded to a firmer foam for greater support.

The hinge connections between the mattress components may be formed of sheet-like materials, such as fabrics, films, laminates and elastics. The tethers between mattress components in the second embodiment may be formed of sheet-like materials, such as fabrics, films, laminates and elastics.

To enhance stability of the mattress in the upright configuration suitable for a crib mattress, releasable fasteners may be applied to end surfaces of the central mattress section and to surfaces of the first and second end walls to join the first and second end walls to the central mattress section in the upright position. Similarly, releasable fasteners may be applied to the top surface of the central mattress section and to surfaces of the first and second side walls to join the first and second side walls to the central mattress section in the upright position. Preferably, releasable fasteners may be applied to end surfaces of the side walls and to surfaces of the end walls to join the side walls to the end walls in the upright position. Preferably, releasable fasteners may be applied to lengthwise surfaces of the sidewall extensions and to lengthwise surfaces of the first and second side walls to join the sidewall extensions to the respective side walls.

To enhance stability of the mattresses in the open configuration suitable for a twin mattress, releasable fasteners may be applied to end surfaces of the central mattress section and to surfaces of the first and second end walls to join the first and second end walls to the central mattress section in the open position. Similarly, releasable fasteners may be applied to side surfaces of the central mattress section and to surfaces of the first and second side walls to join the first and second side walls to the central mattress section in the open position. Preferably, releasable fasteners may be applied to lengthwise surfaces of the sidewall extensions and to side surfaces of the first end wall to join the sidewall extensions to the first end wall when the first end wall is in the open position and the sidewall extensions are in the second position.

A cover may extend substantially over at least the substantially planar body-supporting surface. A cover may extend substantially over at least the central mattress section. A cover may extend over the entirety of the size convertible mattress.

BRIEF DESCRIPTION OF THE DRAWINGS

The present invention will be described in the following detailed description with reference to the following drawings in which:

FIG. 7 is a partial perspective view of a crib configuration for a size-convertible mattress of a second embodiment according to the invention;

FIG. 8 is a perspective view of the size-convertible mattress of FIG. 7 in which end walls and side walls are partially disassembled from the crib configuration; and FIG. 9 is a partial perspective view of the size-convertible mattress of FIG. 7 in its twin bed configuration.

DESCRIPTION OF THE PREFERRED EMBODIMENTS

Figure 1:
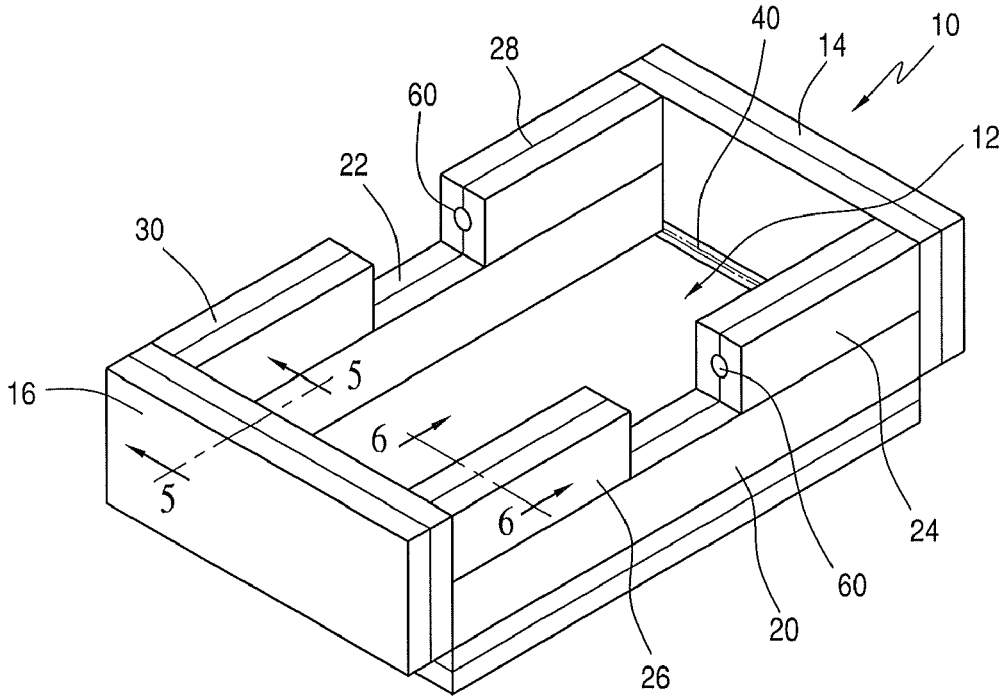
FIG. 1 is a perspective view of a crib configuration for a size-convertible mattress of one embodiment according to the invention.

Referring to FIG. 1, one embodiment of a size-convertible mattress is shown in a crib configuration 10. The mattress in the crib configuration 10 has a central mattress section 12 surrounded by upstanding end walls 14, 16 and side walls 20, 22. The central mattress section 12 is of a size having a generally planar sleeping surface to accommodate an infant or small child. The upstanding end walls 14, 16 and side walls 20, 22 serve as bolster cushions or protective barriers between the spindles or poles or side walls of the crib furniture and the sleeping surface of the central mattress section 12. In its crib configuration 10 the mattress may have outer periphery dimensions comparable to a standard crib mattress, such as about 27 inches by 52 inches (69 cm by 131 cm).

Figure 6:
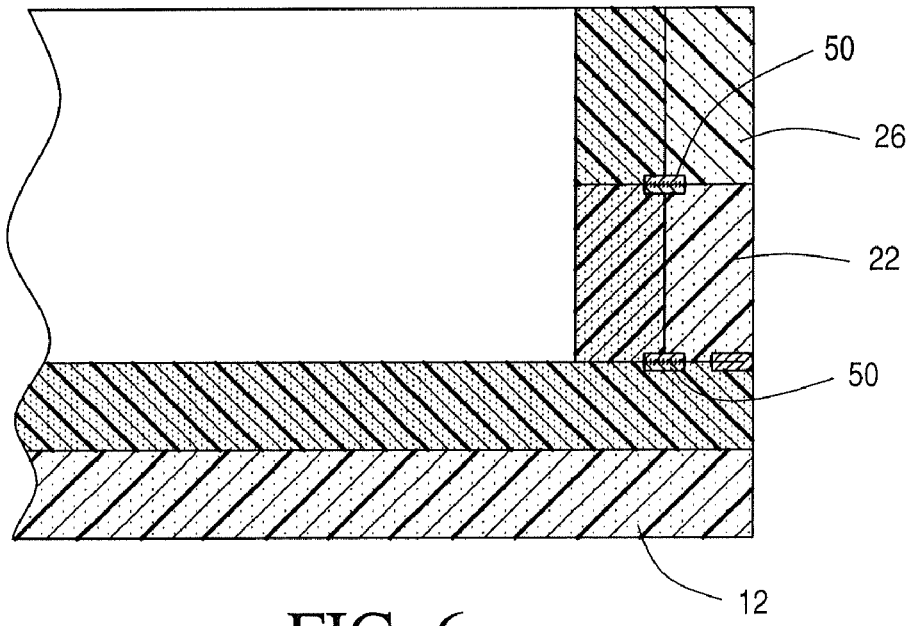
FIG. 6 is a transverse section taken along line 6-6 in FIG. 1.

The size-convertible mattress may be converted from its crib configuration 10 (FIG. 1) to a twin mattress configuration 70 (FIG. 4) upon rotating the end walls 14, 16 and side walls 20, 22 in a manner as described herein. In the crib configuration 10 (FIG. 1), the side walls 20, 22 are removably joined to the planar top surface of the central mattress section 12 with fasteners 50, such as hook and loop strips (sometimes referred to as Velcro® fasteners). In the crib configuration 10 (FIG. 1), the end walls 14, 16 are removably joined to end portions of the side walls 20, 22 and sidewall extensions 24, 26, 28, 30 with fasteners 50, such as hook and loop strips. FIG. 6 illustrates the connections with fasteners 50 that hold the second end wall 16 to the ends of the first side wall 20 and second sidewall extension 26.

Figure 5:
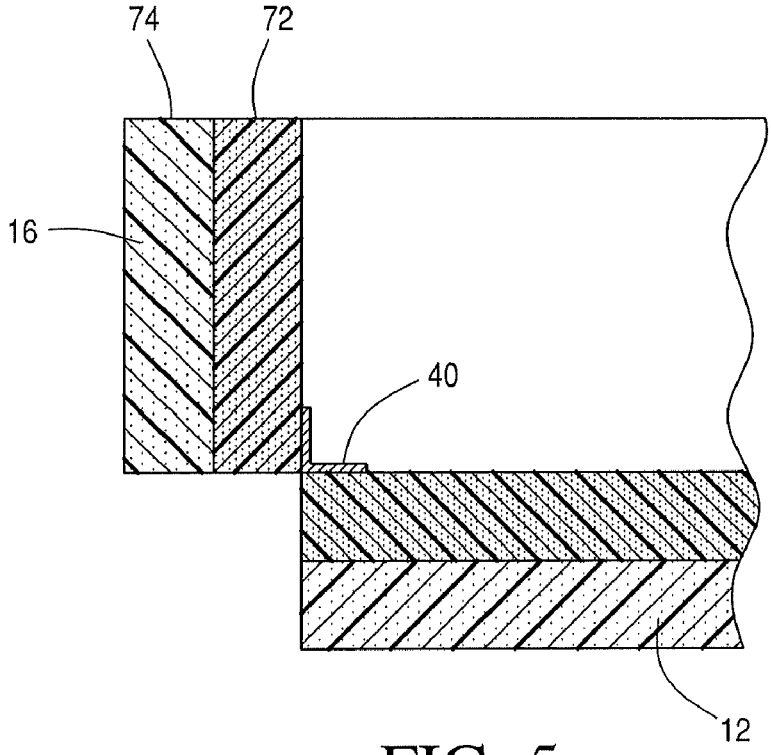
FIG. 5 is a longitudinal section taken along line 5-5 in FIG. 1.

The first and second end walls 14, 16 have hinges 40 formed at their bottom corners. For example, a first portion of a hinge 40 is joined or attached to an inner surface of the first end wall 14, and a second portion of a hinge 40 is joined or attached to a top planar surface of the central mattress section 12. See FIG. 5. Hinges 40 may be formed of a resilient material that may be repeatedly bent back and forth as desired for converting the mattress from a crib configuration 10 to a twin mattress configuration 70. The hinges preferably are adhesively attached or flame laminated to surfaces of the mattress components. The hinges may be joined to the surfaces of the components forming the mattress with adhesive, or by flame lamination or by stitching or by other known attachment means. In flame lamination, foam surfaces may be heated to softening and the hinge material may be applied to the softened surface portion(s). Upon cooling, a bond between hinge material and foam material is formed. Possible materials to form the hinges include fabrics, such as nylons, rip-stop nylon, and CORDURA nylon. The fabrics may be woven, and may be coated with moisture-resitant barrier-coatings.

In the first mattress embodiment (FIG. 1), the end walls may have dimensions of about 12 inches in height, 27 inches in length and 6 inches in width. The side walls may have dimensions of about 6 inches in height, 51 inches in length and 6 inches in width. The sidewall extensions may have dimension of about 6 inches in height, 20 inches in length and 6 inches in width.

Figure 2:
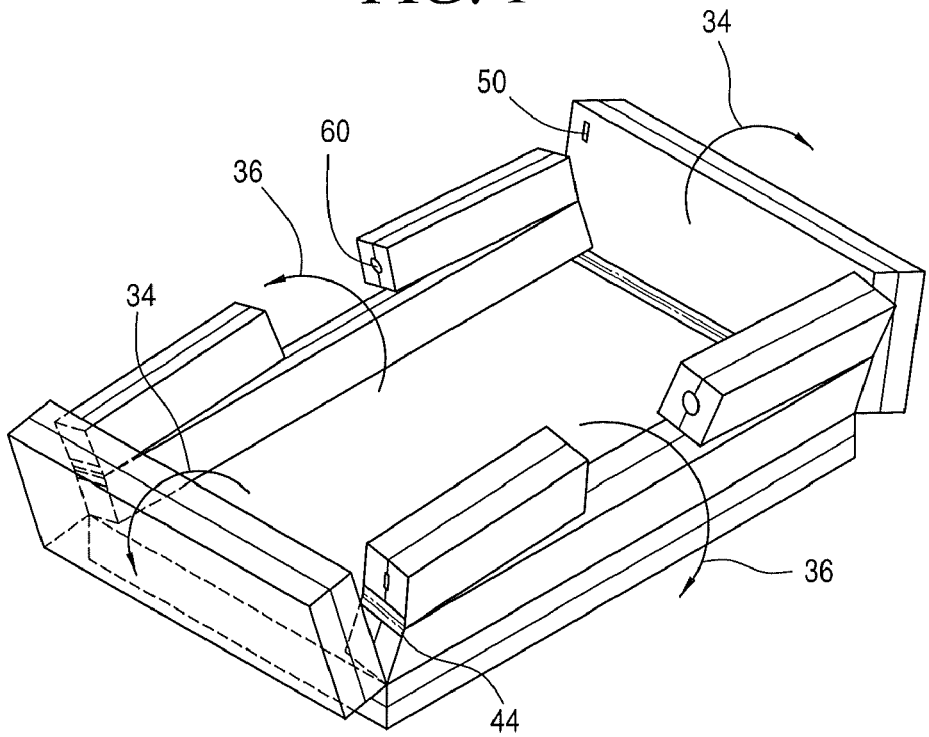
FIG. 2 is a perspective view of the size-convertible mattress of FIG. 1 in which end walls and side walls are partially disassembled from the crib configuration.
Figure 3:
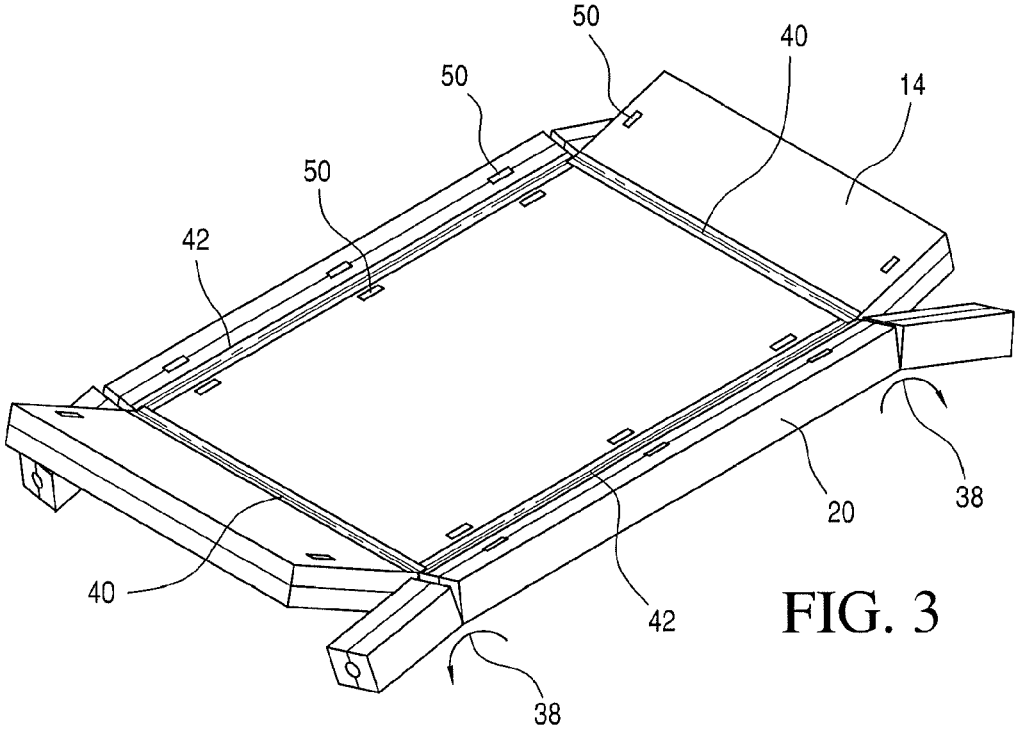
FIG. 3 is a perspective view of the size-convertible mattress of FIG. 1 in which the end walls, side walls and sidewall extensions are in open position for a twin bed configuration.

As shown in FIG. 2, the first end wall 14 may be rotated about its hinge 40 and folded down in the direction of arrow 34 so as to lay flat. Compare FIGS. 3 and 4 with FIG. 2. Upon rotating the first end wall 14, the fasteners 50 holding the first end wall to end surfaces of the first and second side walls 20, 22 and first and third sidewall extensions 24, 28 are separated from one another. When fully opened, the inner side surface of the first end wall 14 forms a plane or substantially forms a plane with the planar top surface of the central mattress section 12 (See FIGS. 3 and 4).

Similarly, the second end wall 16 may be rotated about its hinge 40 and folded down in the direction of arrow 34 so as to lay flat. Compare FIG. 2 with FIGS. 3 and 4. Upon rotating the second end wall 16, the fasteners 50 holding the second end wall to end surfaces of the first and second side walls 20, 22 and second and fourth sidewall extensions 26, 30 are separated from one another. When fully opened, the inner side surface of the second end wall 16 forms a plane or substantially forms a plane with the planar top surface of the central mattress section 12 (See FIG. 4).

Still referring to FIG. 2, the first side wall 20 may be rotated about its hinge 42 in the direction of arrow 36 and folded down so as to lay flat. Compare FIG. 2 with FIGS. 3 and 4. Upon rotating the first side wall 20, the fasteners 50 holding one lengthwise side surface of the first side wall 20 to the top planar surface of the central mattress section 12 are separated from one another. In addition, the second side wall 22 may be rotated about its hinge 42 in the direction of arrow 36 and folded down so as to lay flat. Upon rotating the second side wall 22, the fasteners 50 holding one lengthwise side surface of the second side wall 22 to the top planar surface of the central mattress section 12 are separated from one another.

When in the crib configuration 10, the first and second sidewall extensions 24, 26 are held in contact with a side surface of the first side wall 20 with fasteners 50 (such as hook and loop fasteners). The longitudinal axes of the first and second sidewall extensions 24, 26 are generally in parallel with the longitudinal axis of the first side wall 20. Once the first side wall 20 is in its open position, fasteners 50 may be released and first and second sidewall extensions 24, 26 may be rotated in the direction of arrows 38 (FIG. 3) about hinges 44 to open positions in which the first and second sidewall extensions are axially aligned with the first side wall 20. Alternatively, the first and second sidewall extensions 24, 26, may be rotated when the first side wall 20 is in its upright position, but after the first and second end walls 14, 16 have been rotated to their open positions. See FIGS. 3 and 4. Similarly, the third and fourth sidewall extensions 28, may be rotated about hinges 44 to open positions in which the third and fourth sidewall extensions 28, 30 are axially aligned with the second side wall 22.

Figure 4:
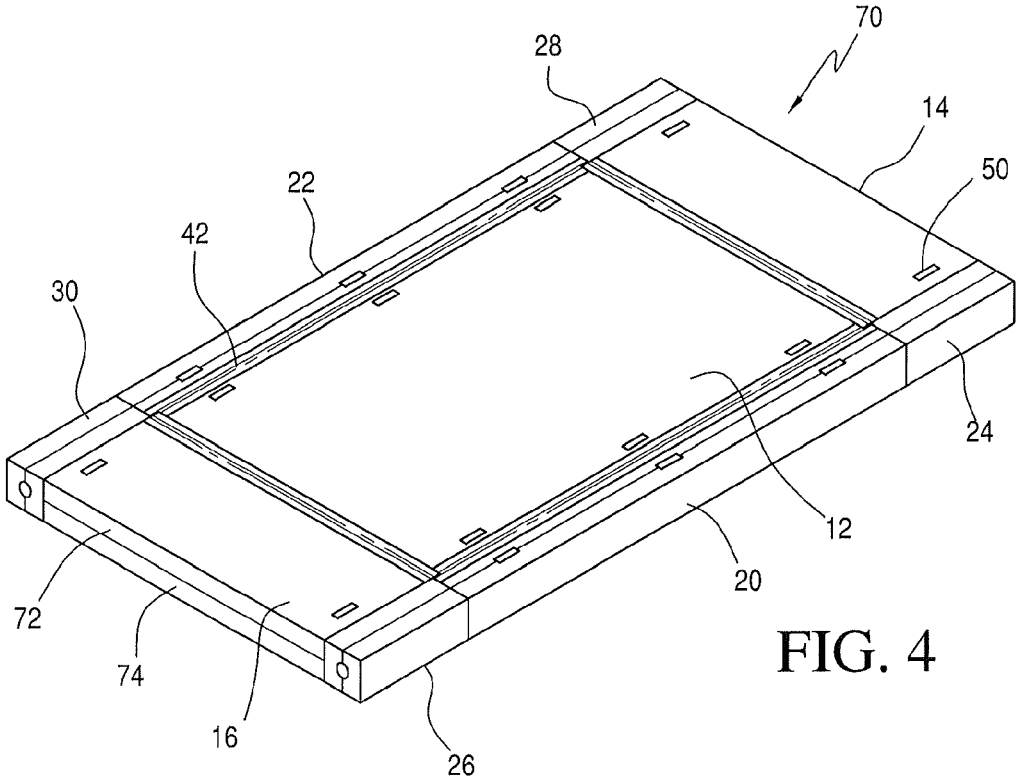
FIG. 4 is a perspective view of the size-convertible mattress of FIG. 1 in its twin bed configuration.

In the twin mattress configuration (FIG. 4), the first and second end walls 14, 16 are unfolded down and aligned with surfaces generally planar with the generally planar top surface of the central mattress section 12. In addition, the first and second side walls 20, 22 are unfolded down and aligned with surfaces generally planar with the generally planar top surface of the central mattress section 12. Moreover, the first, second, third and fourth sidewall extensions 24, 26, 28, 30 are unfolded down and axially aligned with the first and second side walls 20, 22. As so rotated and unfolded, the central mattress section 12, first and second end walls 14, 16, first and second side walls 20, 22 and first, second, third and fourth sidewall extensions 24, 26, 28, 30 together form a generally planar surface of a size of a twin bed mattress configuration 70 (FIG. 4). Fasteners 50 (not shown) may be provided at facing surfaces to hold the various components together in the twin bed mattress configuration (FIG. 4).

In the twin bed mattress configuration 70, the mattress may have an outer periphery dimension comparable to a standard twin mattress, such as about 39 inches by 75 inches (99 cm by 191 cm). The twin bed mattress configuration 70 preferably has a thickness in the range of 6 to 18 inches (15 cm to 46 cm), more preferably about 6 inches (15 cm). The size convertible mattress may be encased in a removable cover (not shown), such as canvas, cotton sheeting, flannel or other suitable fabric, when in the twin bed mattress configuration 70 or the crib configuration 10.

The size-convertible mattress may be folded back from the twin mattress configuration 70 (FIG. 4) to the crib mattress configuration 10 (FIG. 1) by releasing any fasteners between components and rotating the components about hinges 44, 42, 40 in the reverse direction from that shown to unfold the components from the crib configuration 10. The components may be re-fastened together in the crib configuration 10.

The mattress components are formed of one or more resilient materials suitable for holding a reclining infant, child or adult. In a preferred embodiment, the resilient material is a cellular polymer, such as polyurethane foam or latex foam. Cellular polyurethane structures (e.g., foams) typically are prepared by generating a gas during polymerization of a liquid reaction mixture generally comprised of a polyester or polyether polyol, an isocyanate, one or more surfactants, one or more catalysts and one or more blowing agents. The gas causes foaming of the reaction mixture to form the cellular structure. The surfactant(s) stabilize the structure and/or assist in cell opening. Polyurethane foams with varying density and hardness may be formed. Hardness is typically measured as IFD ("indentation force deflection") or CFD ("compression force deflection"). Specifically, $IFD_{25}$ is the force required to compress the foam to 25% of its original thickness or height, and $IFD_{65}$ is the force required to compress the foam to 65% of its original thickness or height. Tensile strength, tear strength, compression set, air permeability, fatigue resistance, support factor, and energy absorbing characteristics may also be varied, as can many other properties. Specific foam characteristics depend upon the selection of the starting materials, the foaming process and conditions, and sometimes on the subsequent processing.

Viscoelastic polyurethane foams are characterized by high vibration damping, body conformance and slow recovery from compression. Most viscoelastic foams have densities in the range of from about 2.0 to 6.0 pounds per cubic foot (32 to 96 $kg/m^3$), but higher densities are sometimes desired (e.g., 8.0 pounds per cubic foot (128 $kg/m^3$) and higher). Viscoelastic foams have gained popularity for bedding applications because such foams are advertised as reducing pressure points, which are believed to cause tossing and turning during sleep.

Representative polyurethane foams suitable for mattresses and cushions, such as bolsters and pillows, include foams offered by FXI Foamex Innovations under brands REFLEX, REFLEX NATURAL, AERUS and AERUS NATURAL. Such foams may have densities in the range of about 1 to 10 pounds per cubic foot, preferably about 2 to 6 pounds per cubic foot, and $IFD_{25}$ in the range of 7 to 70 pounds per square inch. Representative latex foams suitable for mattresses and cushions, such as bolsters and pillows include latex foams offered by FXI Foamex Innovations under brand NATURAL LATEX FROM FXI. Such latex foams have densities in the range of about 1 pounds per cubic foot and up to about 30 pounds per cubic foot.

The central mattress section 12, first and second end walls 14, 16, first and second side walls 20, 22, and first, second, third, fourth sidewall extensions 24, 26, 28, 30 are shown in FIGS. 1-6 as dual components. In this embodiment, when the mattress is in the twin bed configuration (FIG. 4), the top layer 72 forming the reclining surface of the mattress preferably comprises a resilient cellular polymer, such as polyurethane foam, or a slow-recovery foam, such as a viscoelastic foam, and the bottom layer 74 forming the supporting surface of the mattress comprises a firm polyurethane foam. For example, the top layer 72 may comprise an ENERGIA polyurethane foam with a density of 3 to 4 pounds per cubic foot, and the bottom layer 74 may comprise a REFLEX foam with a density of 3 to 4 pounds per cubic foot. As another example, the top layer 72 may comprise a polyurethane foam with a density of 4 pounds per cubic foot and an $IFD_{25}$ in the range of 35 to 65 pounds per square inch, and bottom layer 74 may comprise a viscoelastic foam with a density of 3.5 pounds per cubic foot and an $IFD_{25}$ of 12 pounds per square inch.

When the mattress is in the crib configuration 10 (FIG. 1), preferably the firm layer 74 forms the body-supporting surface of the central mattress section 12. When the mattress is in the twin bed configuration 70 (FIG. 6), a user may position said mattress with either the firm layer 74 or the softer top layer 72 as the body-supporting surface.

To make a multi-layer configuration, the two different foam layers 72, 74 are joined together, such as by co-molding, flame lamination or adhesive bonding. Then, the components forming the central mattress section 12, first and second end walls 14, 16, first and second side walls 20, 22, and first, second, third, fourth sidewall extensions 24, 26, 28, 30 are cut to desired size. These components are then connected by various hinges 40, 42, 44 to form the size-convertible mattress.

The sidewall extensions 24, 26, 28, 30 may be formed with one or more voids 60 therein. Voids 60 are suitable for receiving toys or accessories (not shown) when the size convertible mattress is in its crib configuration 10 (FIG. 1). Such voids 60 do not detract from body-supporting characteristics of the sidewall extensions when the mattress is in its twin bed configuration 70 (FIG. 4).

Referring next to FIGS. 7-9, a second embodiment of a size-convertible mattress according to the invention has a crib configuration 110 in which a central mattress section 112 is surrounded by upstanding end walls 114, 116 and side walls 120, 122. In its crib configuration 110 the mattress of this second embodiment may have outer periphery dimensions comparable to a standard crib mattress, such as about 27 inches by 52 inches (69 cm by 131 cm).

In the second mattress embodiment (FIG. 7), the end walls may have dimensions of about 18 inches in height, 27 inches in length and 6 inches in width. The side walls may have dimensions of about 6 inches in height, 51 inches in length and 6 inches in width. The sidewall extensions may have dimension of about 6 inches in height, 20 inches in length and 6 inches in width The size convertible mattress of the second embodiment may be converted from its crib configuration 110 to a twin mattress configuration 170 (FIG. 9) upon separating the first and second end walls 114, 116 and side walls 120, 122 and reattaching them to side surfaces of the central mattress section 112 in a manner as described herein. In the crib configuration 110 (FIG. 7), the side walls 120, 122 are removably joined to the planar top surface of the central mattress section 112 with fasteners 50, such as hook and loop strips (sometimes referred to as Velcro® fasteners). In the crib configuration 110 (FIG. 7), the end walls 114, 116 are removably joined to end portions of the side walls 120, 122 and sidewall extensions 124, 126, 128, 130 with fasteners 50, such as hook and loop strips. Fastener connections are similar to those used in the first embodiment described with reference to FIGS. 1-6.

The first and second end walls 114, 116 have tethers 100 formed at their bottom corners. For example, a first portion of a tether 100 is joined or attached to an outer surface of the first end wall 114, and a second portion of a tether 100 is joined or attached to a bottom generally planar surface of the central mattress section 112. See FIG. 7. Possible materials to form the tethers 100 include fabrics, laminates and elastics. Woven nylon or cotton that includes elastomeric stretch yarns is one example of a fabric with stretch that may be used. Resilient rubber or latex sheeting are examples elastics that may be used. The tether material may be coated with moisture-resistant barrier-coatings. The tethers 100 may be joined to the surfaces of the components forming the mattress with adhesive, or by flame lamination or by stitching or by other known attachment means.

As shown in FIG. 8, the second end wall 116 may separated from the first and second side walls 120, 122 and second and fourth sidewall extensions 126, 130 and turned 90 degrees (rotated) in the direction of arrow 134 so as to lay flat. Upon rotating the second end wall 116, the fasteners 50 holding the second end wall to end surfaces of the first and second side walls 120, 122 and second and fourth sidewall extensions 126, 130 are separated from one another. When fully opened, the inner side surface of the second end wall 116 forms a plane or substantially forms a plane with the planar top surface of the central mattress section 112 (See FIG. 9). The tethers 100 hold the second end wall 116 in proximity to or adjacent to the central mattress section 112 as the mattress is being converted or reconfigured.

Similarly, the first end wall 114 may be separated from the first and second side walls 120, 122 and first and third sidewall extensions 124, 128 and turned 90 degrees (rotated) so as to lay flat. Upon rotating the first end wall 114, the fasteners 50 holding the first end wall to end surfaces of the first and second side walls 120, 122 and first and third sidewall extensions 124, 128 are separated from one another. When fully opened, the inner side surface of the first end wall 114 forms a plane or substantially forms a plane with the planar top surface of the central mattress section 112. The tethers 100 hold the first end wall 114 in proximity to or adjacent to the central mattress section 112 as the mattress is being converted or reconfigured.

Still referring to FIG. 8, the first side wall 120 may be separated from the central mattress section 112 and turned 90 degrees (rotated) in the direction of arrow 136 and folded down so as to lay flat. Upon rotating the first side wall 120, the fasteners 50 holding one lengthwise side surface of the first side wall 120 to the top planar surface of the central mattress section 112 are separated from one another. In addition, the second side wall 122 may be turned 90 degrees (rotated) in the direction of arrow 136 and folded down so as to lay flat. Upon rotating the second side wall 122, the fasteners 50 holding one lengthwise side surface of the second side wall 122 to the top planar surface of the central mattress section 112 are separated from one another. The tethers 102 hold the first and second side walls 120, 122 in proximity to or adjacent to the central mattress section 112 as the mattress is being converted or reconfigured.

When the second embodiment of the mattress is in the crib configuration 110, the first and second sidewall extensions 124, 126 are held in contact with a side surface of the first side wall 120 with fasteners 50 (such as hook and loop fasteners). The longitudinal axes of the first and second sidewall extensions 124, 126 are generally in parallel with the longitudinal axis of the first side wall 120. Once the first side wall 120 is in its open position, fasteners 50 may be released and first and second sidewall extensions 124, 126 may be rotated in the direction of arrows 138 (FIG. 8) about hinges 144 to open positions in which the first and second sidewall extensions 124, 126 are axially aligned with the first side wall 120. Alternatively, the first and second sidewall extensions 124, 126, may be rotated when the first side wall 120 is in its upright position, but after the first and second end walls 114, 116 have been rotated to their open positions. See FIGS. 8 and 9. Similarly, the third and fourth sidewall extensions 128, 130 may be rotated about hinges 144 to open positions in which the third and fourth sidewall extensions 128, 130 are axially aligned with the second side wall 122.

In the twin mattress configuration (FIG. 9), the first and second end walls 114, 116 are aligned with surfaces generally planar with the generally planar top surface of the central mattress section 112. In addition, the first and second side walls 120, 122 are aligned with surfaces generally planar with the generally planar top surface of the central mattress section 112. Moreover, the first, second, third and fourth sidewall extensions 124, 126, 128, 130 are unfolded down and axially aligned with the first and second side walls 120, 122. As so rotated and unfolded, the central mattress section 112, first and second end walls 114, 116, first and second side walls 120, 122 and first, second, third and fourth sidewall extensions 124, 126, 128, 130 together form a generally planar surface of a size of a twin bed mattress configuration 170 (FIG. 9). Fasteners 50 (not shown) may be provided at facing surfaces to hold the various components together in the twin bed mattress configuration 170 (FIG. 9).

In the twin bed mattress configuration 170, the mattress may have an outer periphery dimension comparable to a standard twin mattress, such as about 39 inches by 75 inches (99 cm by 191 cm). The twin bed mattress configuration 170 preferably has a thickness in the range of 6 to 18 inches (15 cm to 46 cm), more preferably about 6 inches (15 cm).

The size-convertible mattress may be folded back from the twin mattress configuration 170 (FIG. 9) to the crib mattress configuration 110 (FIG. 7) by releasing any fasteners between components and reassembling the end walls 114, 116, side walls 120, 122 and sidewall extensions 124, 126, 128 and 130 in upright configurations, such as by turning or rotating by 90 degrees. The components may be re-fastened together in the crib configuration 110.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

We claim:

1. A mattress, comprising:

a central mattress section defining a top surface and having first and second ends and left and right sides;

a first end wall hingedly connected to said central mattress section at or near said first end, said first end wall pivotably moveable from an upright position to an open position;

a second end wall hingedly connected to said central mattress section at or near said second end, said second end wall pivotably moveable from an upright position to an open position;

a first side wall hingedly connected to said central mattress section at or near said left side, said first side wall pivotably moveable from an upright position to an open position;

a second side wall hingedly connected to said central mattress section at or near said right side, said second side wall pivotably moveable from an upright position to an open position;

a first sidewall extension having a length and defining a lengthwise axis, said first sidewall extension being hingedly connected to an end of the first side wall and pivotably moveable from a first position to a second position in which the lengthwise axis is generally aligned with a lengthwise axis of the first side wall; and a second sidewall extension having a length and defining a lengthwise axis, said second sidewall extension being hingedly connected to an end of the second side wall and pivotably moveable from a first position to a second position in which the lengthwise axis is generally aligned with a lengthwise axis of the second side wall;

wherein the first end wall is not hingedly connected to the first side wall, the first sidewall extension, the second side wall or the second sidewall extension, and wherein the second end wall is not hingedly connected to the first side wall, the first sidewall extension, the second side wall or the second sidewall extension.

2. The mattress of claim 1, further comprising a third sidewall extension having a length and defining a lengthwise axis, said third sidewall extension being hingedly connected to an opposite end of the first side wall and pivotably moveable from a first position to a second position in which the lengthwise axis is generally aligned with the lengthwise axis of the first side wall.

3. The mattress of claim 2, further comprising a fourth sidewall extension having a length and defining a lengthwise axis, said fourth sidewall extension being hingedly connected to an opposite end of the second side wall and pivotably moveable from a first position over the second side wall to a second position in which the lengthwise axis is generally aligned with the lengthwise axis of the second side wall.

4. The mattress of claim 1, wherein when the first and second end walls are in the upright position, the first and second side walls are in the upright position, the top surface of the central mattress section defines a body-supporting surface enclosed within the first and second end walls and the first and second side walls.

5. The mattress of claim 1, wherein when the first and second end walls are in the open position, the first and second side walls are in the open position, and first and second sidewall extensions are in the second position, a substantially planar body-supporting surface is formed that includes the central mattress section, the first and second end walls and the first and second side walls.

6. The mattress of claim 5, wherein the substantially planar body-supporting surface further comprises the first and second sidewall extensions.

7. The mattress of claim 5, further comprising a cover extending substantially over at least the substantially planar body-supporting surface.

8. The mattress of claim 1, wherein the lengthwise axis of the first sidewall extension is parallel or substantially parallel to the lengthwise axis of the first side wall when the first sidewall extension is in the first position.

9. The mattress of claim 1, wherein the lengthwise axis of the second sidewall extension is parallel or substantially parallel to the lengthwise axis of the second side wall when the second sidewall extension in is the first position.

10. The mattress of claim 1, wherein the central mattress section, first end wall, second end wall, first side wall, second side wall, first sidewall extension and second sidewall extension are formed of one or more materials selected from the group consisting of: polyurethane foam, viscoelastic foam, and latex foam.

11. The mattress of claim 1, wherein at least the central mattress section is formed as a composite of two or more foams of varying support characteristic or resiliency.

12. The mattress of claim 1, wherein connections between the central mattress section and the first and second side walls comprise hinges formed of a material selected from the group consisting of: fabrics, films, laminates and elastics.

13. The mattress of claim 1, wherein the connections between the central mattress section and the first and second end walls comprise hinges formed of a material selected from the group consisting of: fabrics, films, laminates and elastics.

14. The mattress of claim 1, wherein the connections between the first and second sidewall extensions and the first side wall and the second side wall are hinges formed of a material selected from the group consisting of: fabrics, films, laminates and elastics.

15. The mattress of claim 1, further comprising releasable fasteners applied to the top surface of the central mattress section and to surfaces of the first and second end walls to join the first and second end walls to the central mattress section in the upright position.

16. The mattress of claim 1, further comprising releasable fasteners applied to the top surface of the central mattress section and to surfaces of the first and second side walls to join the first and second side walls to the central mattress section in the upright position.

17. The mattress of claim 1, further comprising releasable fasteners applied to lengthwise surfaces of the first and second sidewall extensions and to lengthwise surfaces of the first and second side walls to join the first sidewall extension to the first side wall and to join the second sidewall extension to the second side wall.

18. The mattress of claim 1, further comprising releasable fasteners applied to end surfaces of the central mattress section and to surfaces of the first and second end walls to join the first and second end walls to the central mattress section in the open position.

19. The mattress of claim 1, further comprising releasable fasteners applied to side surfaces of the central mattress section and to surfaces of the first and second side walls to join the first and second side walls to the central mattress section in the open position.

20. The mattress of claim 1, further comprising releasable fasteners applied to lengthwise surfaces of the first and second sidewall extensions and to side surfaces of the first end wall to join the first and second sidewall extensions to the first end wall when the first end wall is in the open position and the first and second sidewall extensions are in the second position.

21. The mattress of claim 1, further comprising a cover extending substantially over at least the central mattress section.

22. The mattress of claim 1, wherein at least one of the sidewall extensions defines a void therein to receive an accessory or toy.

23. The mattress of claim 1, further comprising releasable fasteners applied to lengthwise surfaces of the first and second sidewall extensions and to side surfaces of the first end wall to join the first and second sidewall extensions to the first end wall when the first end wall is in the open position and the first and second sidewall extensions are in the second position.

24. A mattress, comprising:

a central mattress section defining a top surface and having first and second ends and left and right sides;

a first end wall tethered to said central mattress section at or near said first end, said first end wall moveable from an upright position to an open position;

a second end wall tethered connected to said central mattress section at or near said second end, said second end wall moveable from an upright position to an open position;

a first side wall tethered to said central mattress section at or near said left side, said first side wall moveable from an upright position to an open position;

a second side wall tethered to said central mattress section at or near said right side, said second side wall moveable from an upright position to an open position;

a first sidewall extension having a length and defining a lengthwise axis, said first sidewall extension being connected to an end of the first side wall and pivotably moveable from a first position to a second position in which the lengthwise axis is generally aligned with a lengthwise axis of the first side wall; and a second sidewall extension having a length and defining a lengthwise axis, said second sidewall extension being connected to an end of the second side wall and pivotably moveable from a first position to a second position in which the lengthwise axis is generally aligned with a lengthwise axis of the second side wall;

wherein at least one of the first end wall or the second end wall is not hingedly connected to the first side wall, the first sidewall extension, the second side wall or the second sidewall extension.

25. The mattress of claim 24, wherein when the first and second end walls are in the upright position, the first and second side walls are in the upright position, the top surface of the central mattress section defines a body-supporting surface enclosed within the first and second end walls and the first and second side walls.

26. The mattress of claim 24, wherein when the first and second end walls are in the open position, the first and second side walls are in the open position, and first and second sidewall extensions are in the second position, a substantially planar body-supporting surface is formed that includes the central mattress section, the first and second end walls and the first and second side walls.

27. The mattress of claim 26, wherein the substantially planar body-supporting surface further comprises the first and second sidewall extensions.

28. The mattress of claim 24, wherein the lengthwise axis of the first sidewall extension is parallel or substantially parallel to the lengthwise axis of the first side wall when the first sidewall extension is in the first position.

29. The mattress of claim 24, wherein the lengthwise axis of the second sidewall extension is parallel or substantially parallel to the lengthwise axis of the second side wall when the second sidewall extension in is the first position.

30. The mattress of claim 24, wherein the central mattress section, first end wall, second end wall, first side wall, second side wall, first sidewall extension and second sidewall extension are formed of one or more materials selected from the group consisting of: polyurethane foam, viscoelastic foam, and latex foam.

31. The mattress of claim 24, wherein at least the central mattress section is formed as a composite of two or more foams of varying support characteristic or resiliency.

32. The mattress of claim 24, wherein connections between the central mattress section and the first and second side walls comprise tethers formed of a material selected from the group consisting of: fabrics, films, laminates and elastics.

33. The mattress of claim 24, wherein the connections between the central mattress section and the first and second end walls comprise tethers formed of a material selected from the group consisting of: fabrics, films, laminates and elastics.

34. The mattress of claim 24, wherein the connections between the first and second sidewall extensions and the first side wall and the second side wall are hinges formed of a material selected from the group consisting of: fabrics, films, laminates, and elastics.

35. The mattress of claim 24, further comprising releasable fasteners applied to the top surface of the central mattress section and to surfaces of the first and second side walls to join the first and second side walls to the central mattress section in the upright position.

36. The mattress of claim 24, further comprising releasable fasteners applied to lengthwise surfaces of the first and second sidewall extensions and to lengthwise surfaces of the first and second side walls to join the first sidewall extension to the first side wall and to join the second sidewall extension to the second side wall.

37. The mattress of claim 24, further comprising releasable fasteners applied to surfaces of the first and second side walls and to the first and second end walls to join the first end wall to the first side wall and to join the second end wall to the second side wall.

38. The mattress of claim 24, further comprising releasable fasteners applied to end surfaces of the central mattress section and to surfaces of the first and second end walls to join the first and second end walls to the central mattress section in the open position.

39. The mattress of claim 24, further comprising releasable fasteners applied to side surfaces of the central mattress section and to surfaces of the first and second side walls to join the first and second side walls to the central mattress section in the open position.

40. The mattress of claim 24, further comprising a cover extending substantially over at least the substantially planar body-supporting surface.

41. The mattress of claim 24, further comprising a cover extending substantially over at least the central mattress section.

42. The mattress of claim 24, wherein at least one of the sidewall extensions defines a void therein to receive an accessory or toy.

* * * * *